US006211826B1

(12) United States Patent
Aoki

(10) Patent No.: US 6,211,826 B1
(45) Date of Patent: Apr. 3, 2001

(54) ANTENNA DEVICE AND PORTABLE RADIO USING THE SAME

(75) Inventor: Kouta Aoki, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/178,861

(22) Filed: Oct. 26, 1998

(30) Foreign Application Priority Data

Oct. 29, 1997 (JP) ..... 9-311616

(51) Int. Cl.[7] ..... H01Q 1/24
(52) U.S. Cl. ..... 343/702; 343/895
(58) Field of Search ..... 343/702, 895, 343/846; 455/90; H01Q 1/24

(56) References Cited

U.S. PATENT DOCUMENTS 5,561,437 * 10/1996 Phillips et al. ..... 343/702
5,703,602 * 12/1997 Casebolt ..... 343/702
5,854,606 * 12/1998 Kawahata et al. ..... 343/702
5,870,066 * 2/1999 Asakura et al. ..... 343/702

* cited by examiner

*Primary Examiner*—Hoanganh Le
(74) *Attorney, Agent, or Firm*—Pearne & Gordon LLP

(57) ABSTRACT

An antenna device has an antenna element 1 with a feeding point 3 which is provided in the casing 3 of a portable radio. Furthermore, a conductor element is provided in the casing, supplied with power from the same feeding point as what is connected to the antenna element and excited in phase with the antenna element and in the positive polarity. The antenna element and the conductor element both function as antennas and even when radiation from the antenna element is restrained because the antenna element is situated close to or brought into contact with the human body, the radiation from the conductor element is made possible, whereby the gain of the antenna is prevented from deteriorating.

14 Claims, 4 Drawing Sheets

ANTENNA DEVICE AND PORTABLE RADIO USING THE SAME

BACKGROUND OF THE INVENTION

The present invention relates to an antenna device and a portable radio incorporating the antenna device and more particularly aims at reducing the size of a portable radio by simplifying the circuit configuration of an antenna device.

Radiation characteristics during a call in the antenna device of a typical conventional portable radio are strongly affected by the human body (of a user). In such a conventional portable radio, a diversity antenna for switching a plurality of antennas from one to another is used for improving the radiation gain of the antenna.

FIG. 4 shows an antenna device in a conventional portable radio. The antenna device comprises an antenna element 1 projecting outward from the casing 2 of the portable radio, an internal antenna element 8 provided inside the casing 2, a joint 4 which is electrically connected to the feeding point 3 of the antenna element 1, a matching circuit unit 5 for matching the input impedance of the antenna element 1 with the radio circuit unit 6 of the portable radio, a switch 7 for selecting the antenna element 1 or the internal antenna element 8, and a control unit 9 for controlling the switching of the switch 7 by comparing the levels of the electric power received by the antenna element 1 and the internal antenna element 8.

While the switch 7 selects the antenna element 1 in this system, the power received by the antenna element 1 is transmitted to the radio circuit unit 6 via the joint 4 and the matching circuit unit 5. The level of the power thus transmitted to the radio circuit unit 6 is stored in the control unit 9. Then, the control unit 9 sets the switch 7 so as to connect the internal antenna element 8 and the radio circuit unit 6. The power received by the internal antenna element 8 is transmitted to the radio circuit unit 6 and the then power level is stored in the control unit 9.

The control unit 9 compares the levels of the power respectively received by the antenna element 1 and the internal antenna element 8 and changes the switch 7 over to the antenna element that has received the higher power level. The signal transmitted from the radio circuit unit 6 is radiated through the antenna element selected by the control unit 9.

One of the antenna elements is selected in accordance with the level of the power thus received. Therefore, even when the radiation is restrained because one of the antenna elements is situated closer to the human body, the radiation can be given off through the antenna element where the restraint of radiation is lower, whereby the influence of the human body on the radiation characteristics of the antenna can be reduced.

However, there still exists a problem arising from causing the circuitry to be complicated in the conventional antenna device because the switch and the control unit are required to switch antenna elements from one to the other. Another problem lies in the fact that the portable radio can hardly be reduced in size because the number of parts tends to increase.

SUMMARY OF THE INVENTION

An object of the present invention intended to solve the foregoing problems is to provide an antenna device capable of preventing the gain of an antenna from deteriorating during a call with a simplified circuit arrangement. Further, it is provided a small-sized portable radio by the use of such an antenna device.

Accordingly, an antenna device according to the present invention has an antenna element with a feeding point which is provided in the casing of a portable radio, wherein a conductor element is provided in the casing, supplied with power from the same feeding point as what is connected to the antenna element and excited in phase with the antenna element and in the positive polarity.

In consequence, the antenna element and the conductor element both function as antennas and even when radiation from the antenna element is restrained because the antenna element is situated close to or brought into contact with the human body, the radiation from the conductor element is made possible, whereby the gain of the antenna is prevented from deteriorating. Furthermore, the circuit configuration of this antenna device can be simplified as the number of parts is reducible.

Moreover, a small-sized portable radio incorporating the antenna device can be provided.

Furthermore, according to the present invention, the conductor element is formed of a plate-like or linear conductor and its length is adjusted to set a predetermined antenna characteristics.

Moreover, according to the present invention, the conductor element is bent a plurality of times in any position in the casing, so that the antenna device is made compact by reducing the conductor element in size.

Still further, according to the present invention, the conductor element is made to resonate at a frequency slightly deviated from the resonance frequency of the antenna element, whereby it functions as a double-resonance antenna to ensure that broad-band antenna characteristics are obtained.

Still furthermore, according to the present invention, the length of the antenna element set at an electrical length with a wavelength of 0.65 and that of the conductor element is set at an electrical length with a wavelength of approximately 0.4, so that the function of the double-resonance antenna is fulfilled.

Moreover, according to the present invention, a portable radio can be made small-sized by incorporating the above-mentioned antenna device.

DETAILED DESCRIPTION OF THE PREFERRED EMBODIMENTS

A description will subsequently be given of embodiments of the invention with reference to the drawings.

First Embodiments

Figure 1:
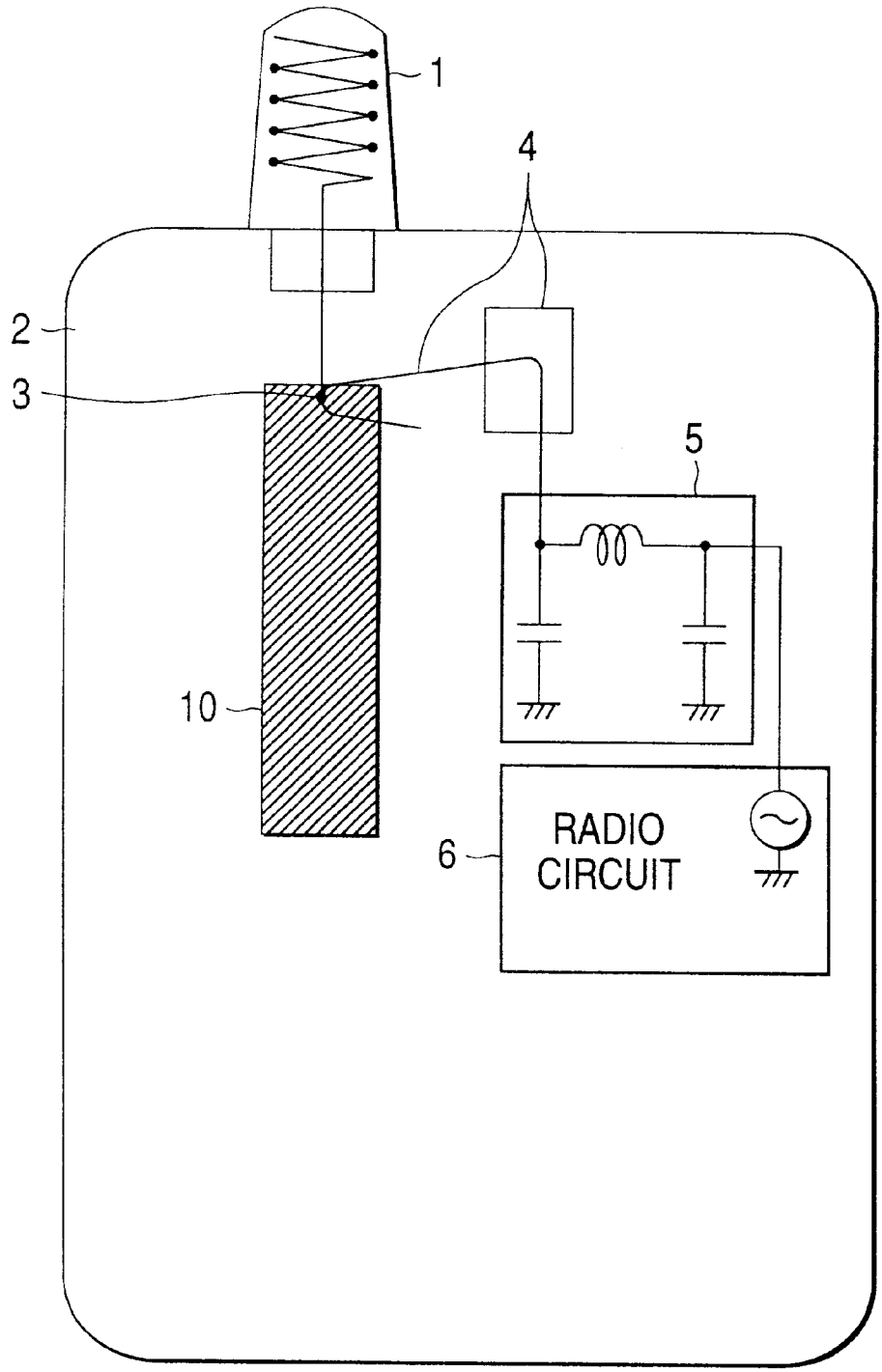
FIG. 1 is a block diagram of an antenna device in a first embodiment of the invention.

As shown in FIG. 1, an antenna device in the first embodiment of the invention comprises an antenna element 1 projecting outward from the casing 2 of a portable radio, a joint 4 which is electrically connected to the feeding point 3 of the antenna element 1, a matching circuit unit 5 for matching the input impedance of the antenna element 1 with the radio circuit unit 6 of the portable radio, and an electroconductive plate-like or linear conductor element 10 contained in the casing 2.

The conductor element 10 is electrically connected to the joint 4 via the same feeding point 3 as what is connected to the antenna element 1. The joint 4 is electrically connected via the matching circuit unit 5 to the radio circuit unit 6 and supplies power from the radio circuit unit 6 to the antenna element 1 and the conductor element 10. Furthermore, the matching circuit unit 5 matches the input impedance of the antenna element 1 and the conductor element 10 as viewed from the feeding point 3 with the radio circuit unit 6 and the power from the radio circuit unit 6 efficiently transmits to the antenna element 1 and the conductor element 10 without causing the power to be reflected at the feeding point 3.

Although the antenna element 1 shown above is in the form of a helical element that is wound like a coil in this case, it may be a linear monopole antenna or a zigzag antenna.

The structure of the antenna element 1 and the constant of the matching circuit unit 5 are designed so that the maximum gain of the antenna is obtainable with respect to a desired frequency in such a state that the conductor element 10 is absent first and the antenna element 1 functions as a monopole antenna.

The conductor element 10 is connected to the joint 4 at the same feeding point 3 as what is connected to the antenna element 1 and adjusted so that resonance is obtainable at a frequency slightly deviated from the resonance frequency of the antenna element 1. In a case where the antenna element 1 has an electrical length with a wavelength of 0.65, the length of the conductor element 10 corresponds to a wavelength of about 0.4.

At this time, the conductor element 10 functions as an antenna which is excited in phase with the antenna element 1 and in the positive polarity. Consequently, the resonance of the conductor element 10 in addition to that of the antenna element 1 is obtained in this antenna device, the antenna device is adapted for use as a so-called double-resonance antenna having two resonance frequencies, whereby the antenna device is allowed to have broad-band antenna characteristics.

With the addition of the conductor element 10, the input impedance resulting from viewing the antenna side from the feeding point 3 slightly varies from the input impedance with only the antenna element 1. Therefore, the constant of the matching circuit unit 5 is optimized in order to match the constant thereof with the radio circuit unit 6.

In a case where no obstacles exist around the antenna element 1 and the conductor element 10 in this antenna device, electromagnetic waves are radiated from the antenna element 1 and the conductor element 10, respectively. Although radiation from the antenna element 1 is restrained when the antenna element 1 is situated close to or brought into contact with the human body, the gain of the antenna can be prevented from deteriorating in comparison with the case where only the antenna element 1 is provided since the electromagnetic wave is radiated from the conductor element 10.

Thus, in the antenna device in this embodiment of the invention, the antenna element and the conductor element both are made to function as antennas by adding the conductor element supplied with power from the same feeding point as what is connected to the antenna element in the casing of the antenna device and excited in phase with the antenna element and in the positive polarity, and adjusting the length of the conductor element.

Therefore, the antenna device according to the present invention is essentially made up of a smaller number of parts and simpler in circuit configuration than the conventional one. Moreover, a portable radio can be made smaller in size by incorporating the antenna device therein.

The same effect as noted above is made achievable by providing the antenna element 1 inside the casing instead of providing it outside the casing as shown in FIG. 1.

Second Embodiment

An antenna device in the second embodiment of the invention can also be made smaller in size by bending the conductor element.

Figure 2:
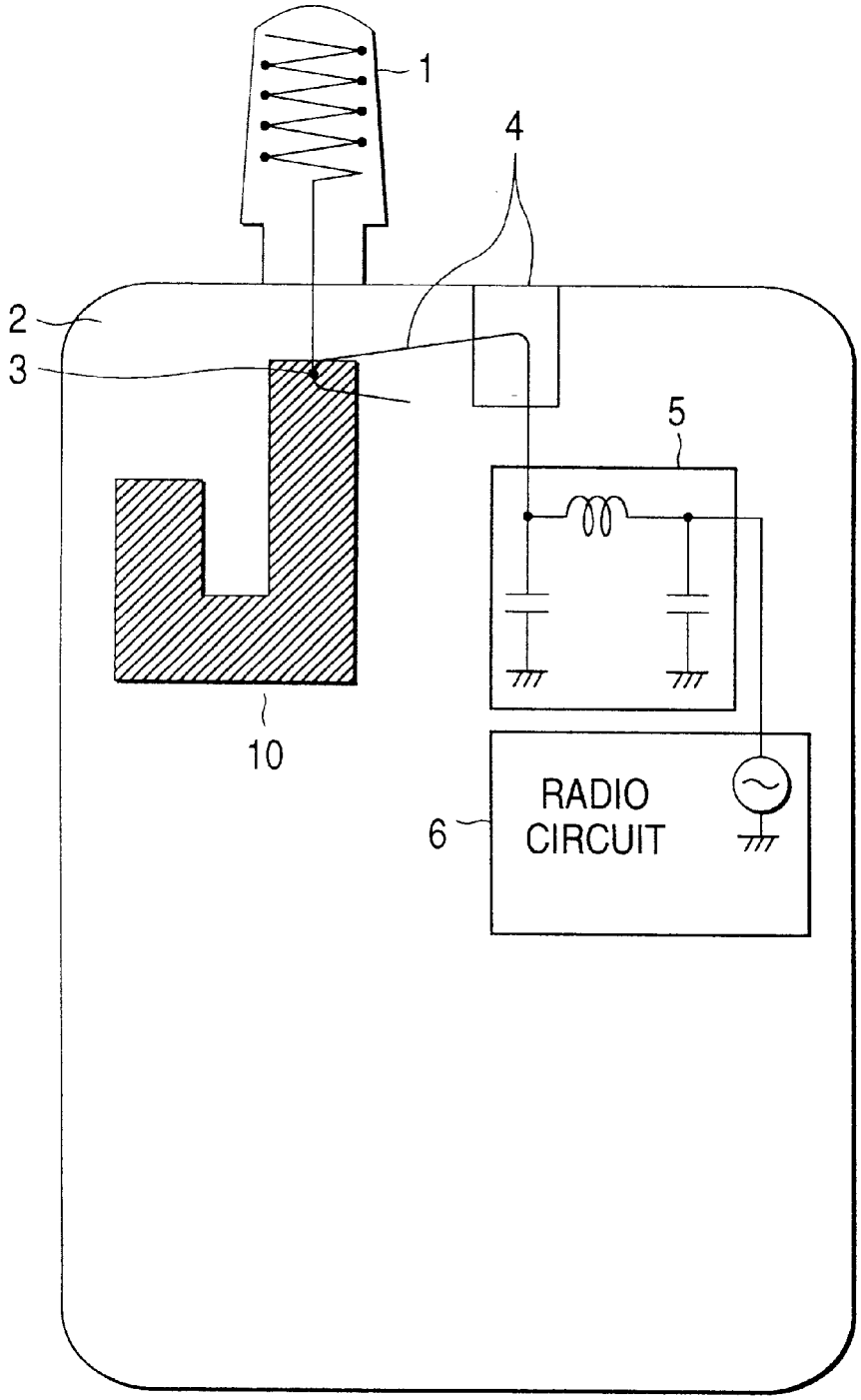
FIG. 2 is a block diagram of an antenna device in a second embodiment of the invention.
Figure 3:
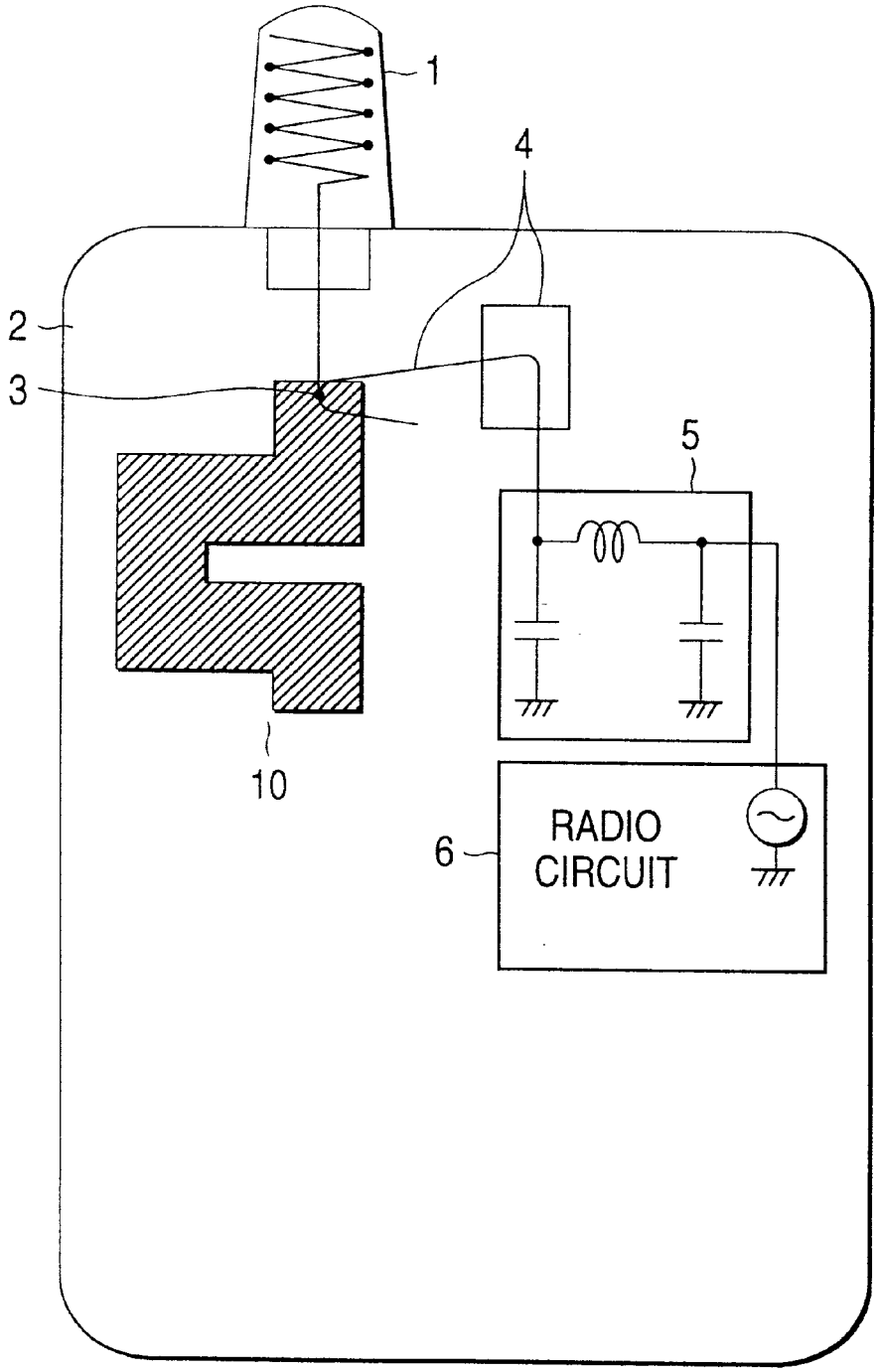
FIG. 3 is a block diagram of another antenna device in the second embodiment of the invention.
Figure 4:
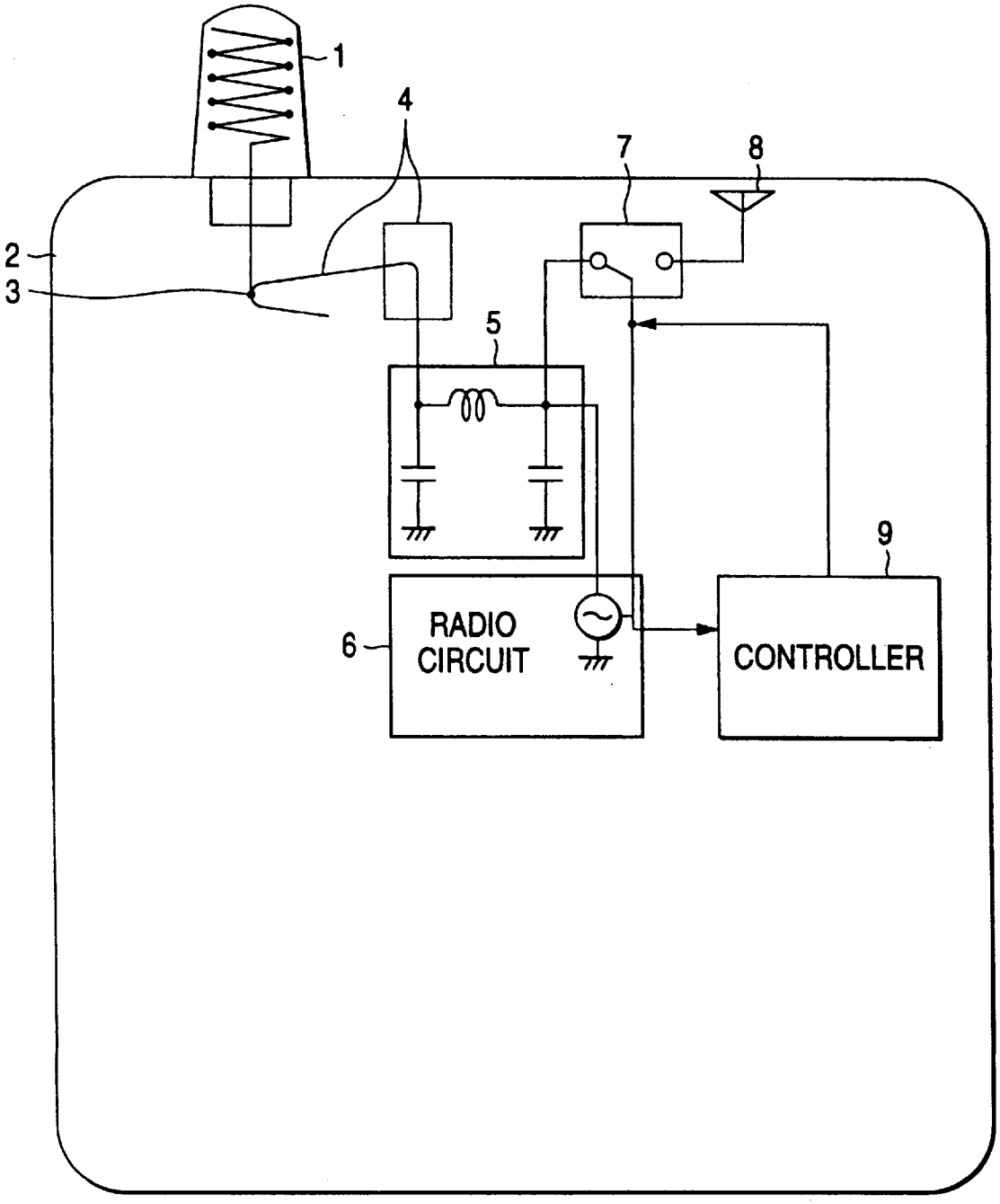
FIG. 4 PRIOR ART
FIG. 4 is a block diagram of a conventional antenna device.

As shown in FIGS. 2 or 3, this antenna device is equipped with a conductor element 10 which is bent twice or greater in any position. As in the first mode for carrying out the invention, the conductor element 10 is supplied with power in the same position as that of an antenna element 1 and excited in phase with the antenna element 1 and in the positive polarity. The rest of the constitution remains unchanged from the first embodiment of the invention.

This conductor element 10 is adjusted so that it has substantially the same electrical length that the linear conductor element has, whereby the same resonance condition as that of the linear one is obtainable. Obtaining the resonance enables the antenna to have the same radiation characteristics as in the first mode for carrying out the invention and when no obstacles exist around the antenna element 1 and the conductor element 10, electromagnetic waves are respectively radiated from the antenna element 1 and the conductor element 10. Even when radiation from the antenna element 1 is restrained because the antenna element 1 is situated close to or brought into contact with the human body, the gain of the antenna is prevented from lowering since the electromagnetic wave is radiated from the conductor element 10.

As the conductor element 10 is bent in any position in this antenna device, this conductor element can be made smaller in size further than the linear conductor element. Therefore, a portable radio can be made smaller in size by incorporating the antenna device therein.

The direction in which the conductor element is bent and the number of times that the conductor element is bent are optional and not limited to those shown in FIGS. 2 and 3.

As is obvious from the description given above, the gain of the antenna in the antenna device according to the present invention due to the approach or contact of the antenna to or with the human body can be prevented from deteriorating by the use of a smaller number of parts as well as a simpler circuit configuration.

Furthermore, the antenna device having such a conductor element as has been bent the plurality of times in any position can be made smaller in size.

Moreover, the portable radio according to the present invention can also be made smaller in size by incorporating any one of these antenna devices.

What is claimed is:

1. An antenna device comprising:

an antenna element having a feeding point which is provided in a casing of a portable radio; and a conductor element provided in said casing, to which a power is supplied from said feeding point;

wherein said conductor element extends longitudinally from the feeding point in one direction and said antenna element extends longitudinally from the feeding point in an opposite direction; and wherein said conductor element is excited in phase with said antenna element and in the positive polarity.

2. The antenna device as claimed in claim 1, wherein said conductor element is formed of a plate-like conductor.

3. The antenna device as claimed in claim 2, wherein said conductor element has a plurality of bends.

4. The antenna device as claimed in claim 1, wherein said conductor element resonates at a frequency slightly deviated from a resonance frequency of said antenna element.

5. The antenna device as claimed in claim 4, wherein said antenna element has an electrical length with a wavelength of 0.65 and wherein said conductor element has an electrical length with a wavelength of approximately 0.4.

6. The antenna device according to claim 1, wherein the conductor element and the antenna element are disposed on relatively opposite sides of said feeding point.

7. The antenna device according to claim 1, wherein the antenna element is disposed outside of the casing.

8. A portable radio comprising:

a casing;

an antenna element having a feeding point which is provided in said casing; and a conductor element provided in said casing, to which power is supplied from said feeding point;

wherein said conductor element extends longitudinally from the feeding point in one direction and said antenna element extends longitudinally from the feeding point in an opposite direction; and wherein said conductor element is excited in phase with said antenna element and in the positive polarity.

9. The portable radio as claimed in claim 8, wherein said conductor element is formed of a plate-like conductor.

10. The portable radio as claimed in claim 9, wherein said conductor element has a plurality of bends.

11. The portable radio as claimed in claim 8, wherein said conductor element resonates at a frequency slightly deviated from a resonance frequency of said antenna element.

12. The portable radio as claimed in claim 11, wherein said antenna element has an electrical length with a wavelength of 0.65 and wherein said conductor element has an electrical length with a wavelength of approximately 0.4.

13. The portable radio according to claim 8, wherein the conductor element and the antenna element are disposed on relatively opposite sides of said feeding point.

14. The portable radio according to claim 8, wherein the antenna element is disposed outside of the casing.

* * * * *